US006681819B2

(12) United States Patent
Cremona

(10) Patent No.: US 6,681,819 B2
(45) Date of Patent: Jan. 27, 2004

(54) ROTATING SHEARING MACHINE FOR THE PRODUCTION OF SHEARED WOODEN PIECES FROM LOGS AND HAVING LOG INCLINATION MOVEMENT

(75) Inventor: Lorenzo Cremona, Monza (IT)

(73) Assignee: Angelo Cremona S.p.A. (IT)

( * ) Notice: Subject to any disclaimer, the term of this patent is extended or adjusted under 35 U.S.C. 154(b) by 0 days.

(21) Appl. No.: 10/145,238

(22) Filed: May 10, 2002

(65) Prior Publication Data

US 2002/0170628 A1 Nov. 21, 2002

(30) Foreign Application Priority Data

May 17, 2001 (IT) ..... MI2001A1027

(51) Int. Cl.[7] ..... B27L 5/02

(52) U.S. Cl. ..... 144/214; 144/177; 144/211; 269/56; 269/58; 269/309

(58) Field of Search ..... 144/162.1, 177, 144/178, 179, 209.1, 211, 214, 215.3; 269/56, 57, 58, 309, 900, 55

(56) References Cited

U.S. PATENT DOCUMENTS

| | | | | | |
|---|---|---|---|---|---|
| 1,501,551 | A | * | 7/1924 | Beiger | 144/214 |
| 2,633,882 | A | * | 4/1953 | Mengel | 144/214 |
| 4,313,481 | A | * | 2/1982 | Cremona | 144/177 |
| 5,150,746 | A | * | 9/1992 | Weil | 144/177 |
| 5,381,841 | A | * | 1/1995 | Weil | 144/177 |
| 2003/0111786 | A1 | * | 6/2003 | Fries | 269/309 |

* cited by examiner

*Primary Examiner*—W. Donald Bray
(74) *Attorney, Agent, or Firm*—Shlesinger, Fitzsimmons & Shlesinger

(57) ABSTRACT

A station (10) for shearing wood sheets from a log comprises a shearing blade (18) and a pair of chucks (16) supporting log gripping means (21). The chucks are powered to rotate around an axis (20) parallel to the blade and the gripping means (21) are movable to change the inclination of the gripped log with respect to said chuck rotation axis.

10 Claims, 6 Drawing Sheets

Tav. I

Tav. I

Tav. II

Tav. III

Tav. V

Tav. VI

ROTATING SHEARING MACHINE FOR THE PRODUCTION OF SHEARED WOODEN PIECES FROM LOGS AND HAVING LOG INCLINATION MOVEMENT

BACKGROUND OF THE INVENTION

The present invention relates to a rotating shearing machine for the production of wooden sheared pieces starting from a log.

The production of sheared pieces takes place essentially with two machine types, to wit shearing machines with rectilinear trajectory of the blade or the log and machines with circular log trajectory. In general, these machines are called respectively vertical or horizontal shearing machines and rotating shearing machines.

In rectilinear shearing machines the log portion being processed is locked to a worktable which when moving along a rectilinear trajectory with reciprocating motion meets the blade to produce thin sheets usually 0.5 to 1.2 mm thick.

In rotating shearing machines on the other hand, the log is made to rotate around an axis parallel to its extension so that it meets the blade periodically. To rotate the log it is mounted between two powered chucks. To make the log integral with the chucks a "stay log" is generally used. This is a metallic structure or beam with elongated parallelepiped form on which are installed log holding systems.

The sheets obtained with the rotating shearing machine are also thin like those of rectilinear shearing machines. The substantial difference which justifies this much more complicated and difficult to build machine is that for equal log size the length of the sheets obtained is greater because in rotating machines the log cross section is intersected by the blade according to a circumference instead of a straight line as in rectilinear machines.

These machines have been used for a few dozen years just because of their greater output even if they suffer from the never eliminated disadvantage of high scrap at the beginning of the shearing of a log because of the generally tapered shape of the logs. The machine must therefore make several shearing passes to "regularize" the surface of the log with respect to the blade before being able to produce sheared sheets in an acceptable manner. The initial scrap is exceedingly disadvantageous when it is remembered that the most valuable wood is that obtained from the outermost layers of the plant.

The general purpose of the present invention is to remedy the above mentioned shortcomings by making available a rotating shearing machine reducing initial scrap to the minimum. Another purpose is to make available a rotating shearing machine producing sheets having different desired designs of the wood venation on the surface.

SUMMARY OF THE INVENTION

In view of this purpose it was sought to provide in accordance with the present invention a station for shearing wood sheets from a log comprising a shearing blade and a pair of chucks supporting log gripping means with the chucks being powered to rotate around an axis parallel to the blade characterized in that the gripping means are movable to change the inclination of the gripped log with respect to said chuck rotation axis.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings

DETAILED DESCRIPTION OF THE INVENTION

Figure 1:
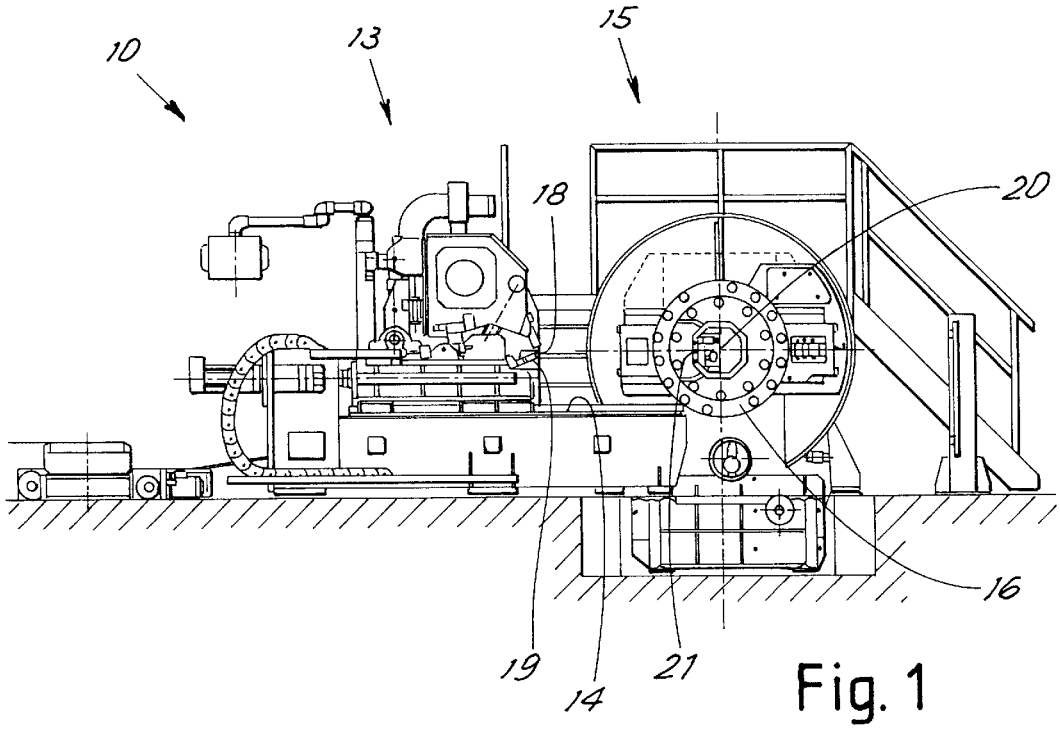
FIGS. 1, 2 and 3 show respectively diagrammatic side elevation, front elevation and plan views of a shearing station in accordance with the present invention.

With reference to the FIGS FIG. 1 shows a side view of a shearing station designated as a whole by reference number 10 and realized in accordance with the present invention. The station comprises a cutting unit 13 having powered horizontal movement along guides 14 and a log movement unit 15. The cutting unit comprises a blade 18 and an underlying pressure bar 19.

Figure 2:
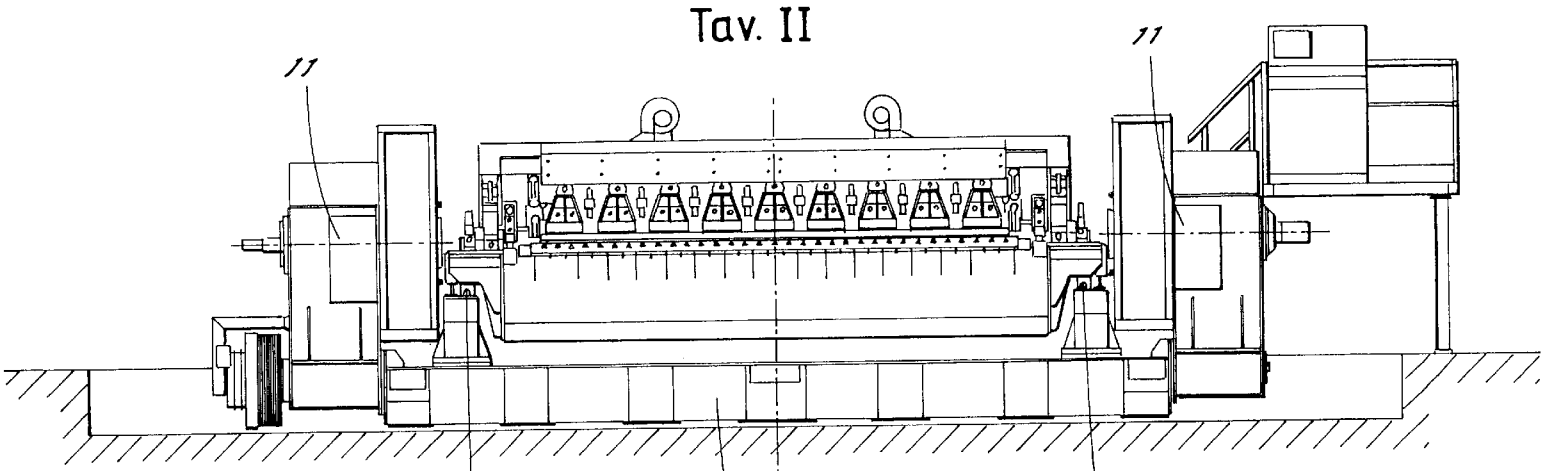
Figure 3:
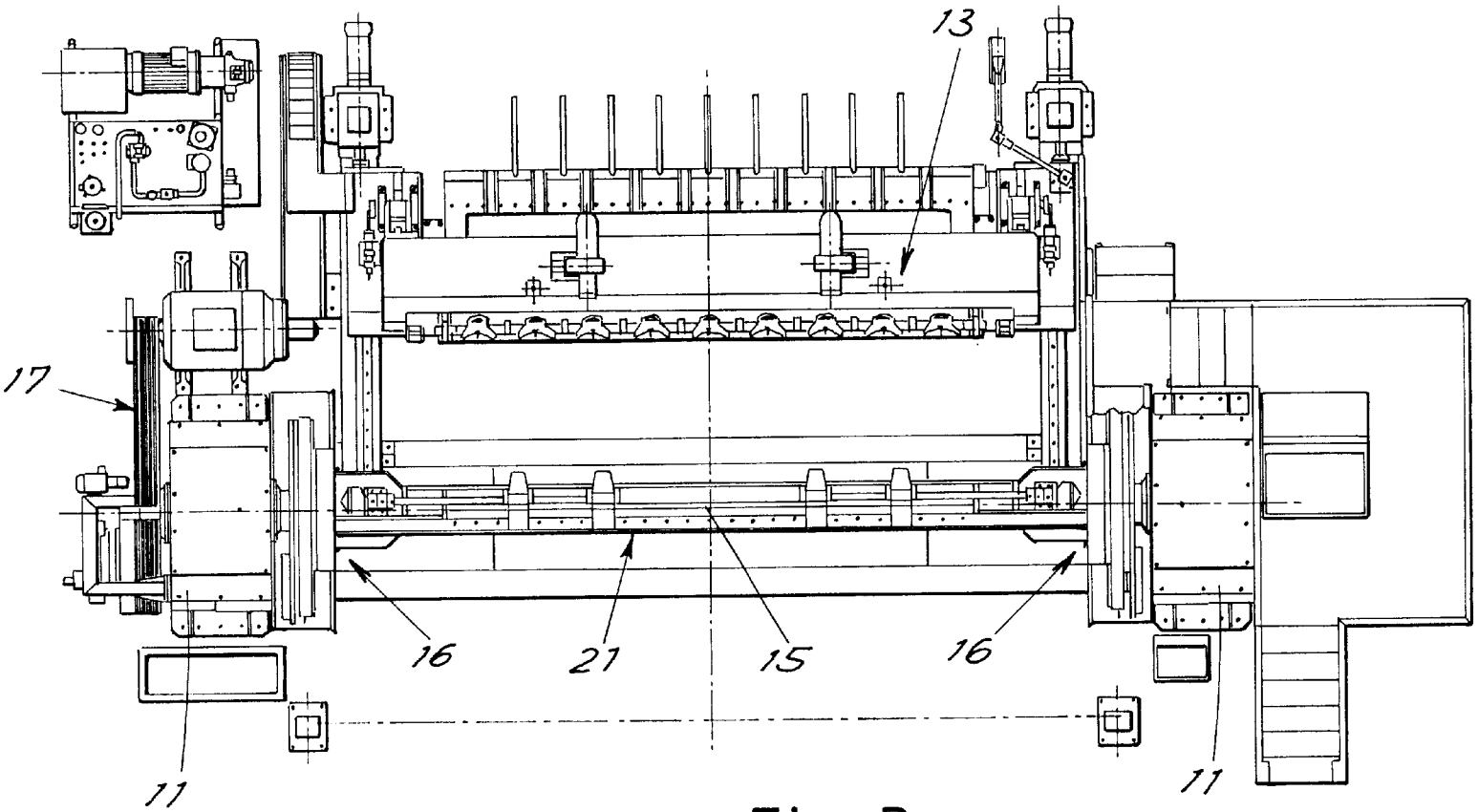

As may be seen in FIGS. 2 and 3 the station 10 comprises a structure fastened to the ground and having two vertical risers 11 and a horizontal connecting bed 12.

Within the vertical risers are located two chucks 16, right and left, which are rotated by a chain & rim unit 17 around the common work axis 20 of the machine parallel to the blade edge. The chucks support means 21 for gripping the log. The combined movements of chuck rotation and running of the cutting unit along the guides 14 perform shearing of the log as readily imaginable to one skilled in the art.

As clarified below and shown diagrammatically in FIG. 8 the gripping means are movable to change the inclination of the gripped log with respect to the chuck rotation axis 20.

Figure 4:
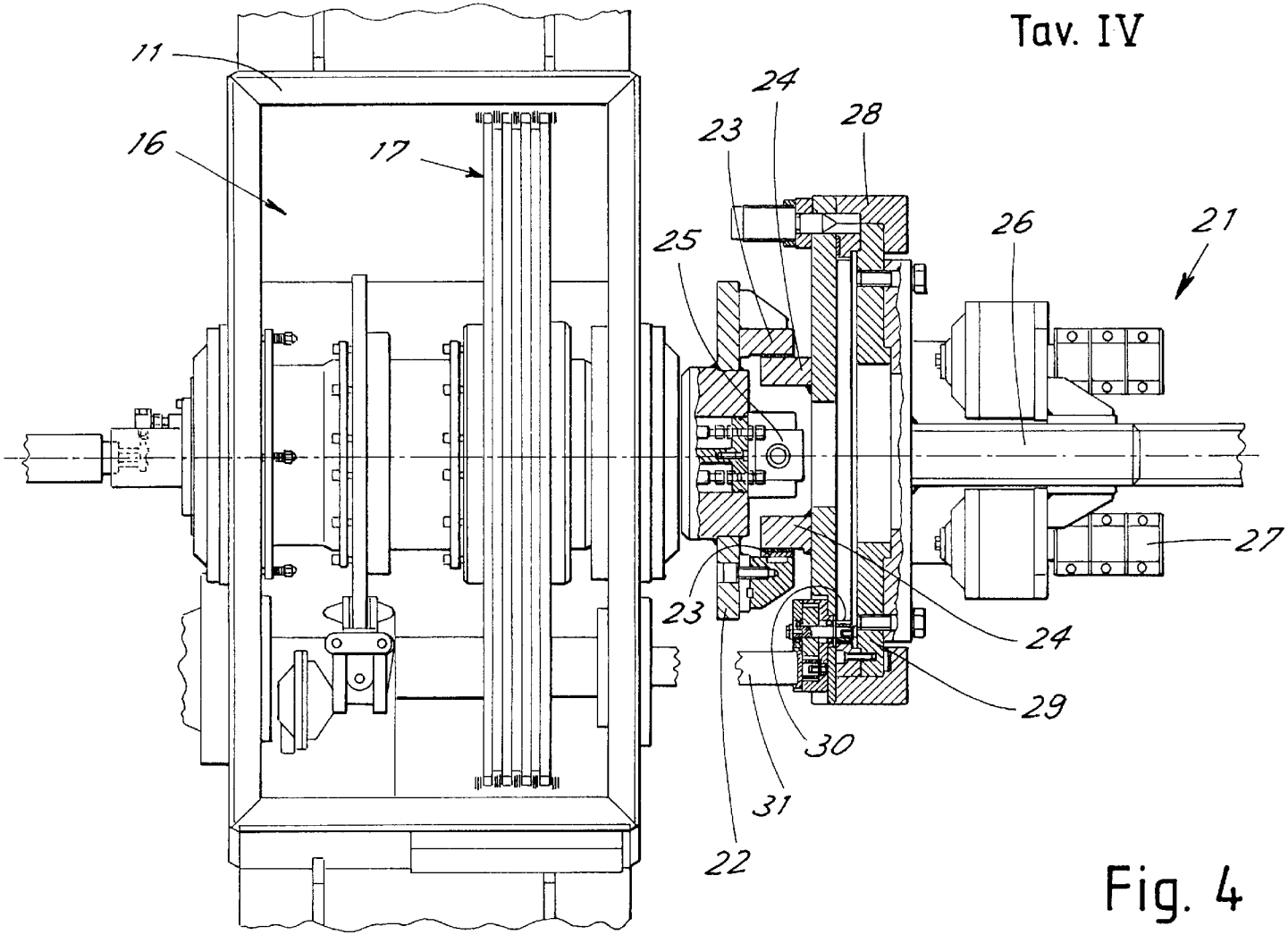
FIGS. 4 and 5 show respectively diagrammatic enlarged and partially cross sectioned plan and front elevation views of a detail of the station of FIG. 1.
Figure 5:
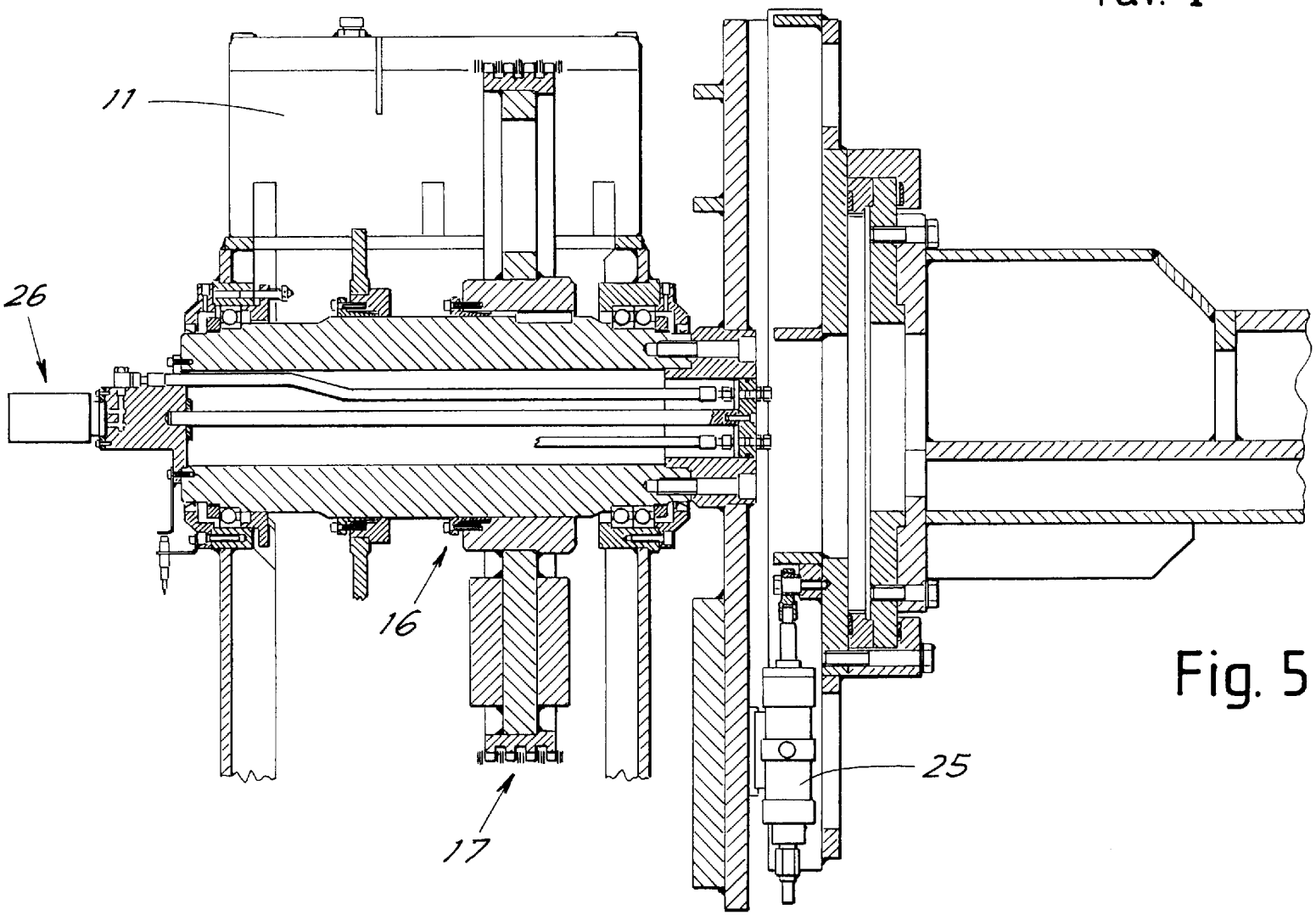

FIGS. 4 and 5 show in greater detail one of the two chucks; the other has a virtually mirror image structure. Connected rigidly to the chucks are fifth wheels 22 bearing rectilinear running guides 23. Engaged in these guides 23 are shoes 24 integral with the log gripping means. The guides are positioned symmetrically arranged with respect to the chuck rotation axis and allow radial running with respect to the rotation axis of each chuck. The guide means have transversal movement or play allowing movement of the gripping means such as to follow the inclination of the log owing to the different radial running of the two ends during adjustment of the machine before the beginning of processing. The radial fluids can comprise a locking system (for example, hydraulic) to prevent movement during processing as diagrammatically shown in the lower guides 23 of FIG. 4.

As may be seen in FIG. 5, on the chuck is also supported an actuator 25 (for example controlled by fluid reaching it through a rotating distributor 26) which moves on command the respective end of the gripping ends 21 along the guides 23 associated with said chuck. This makes it possible to obtain the desired inclination of the log with respect to the rotation axis of the chucks. Inclination of the log takes place in a plane passing through the chuck rotating axis.

Figure 6:
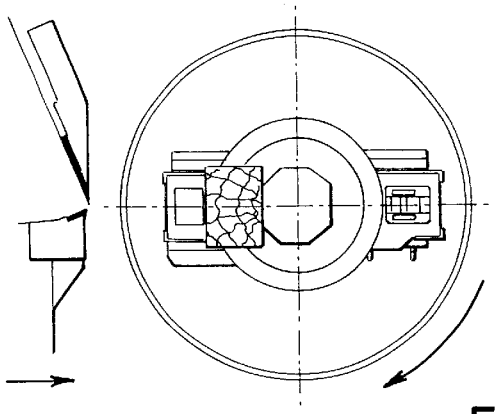
FIG. 6 shows a diagrammatic view of an arrangement of the station members during operation.
Figure 7A:
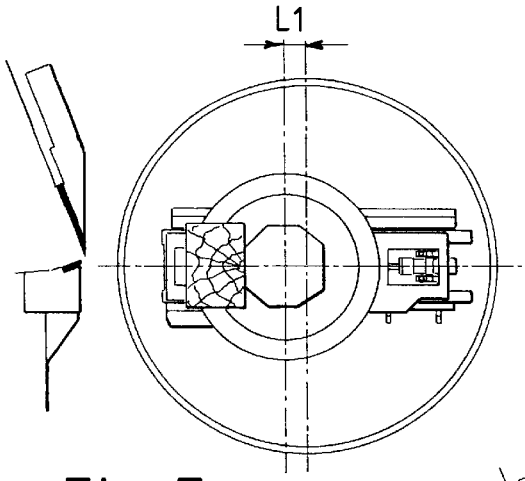
FIGS. 7*a* to 7*d* show possible settings of the station.
Figure 7B:
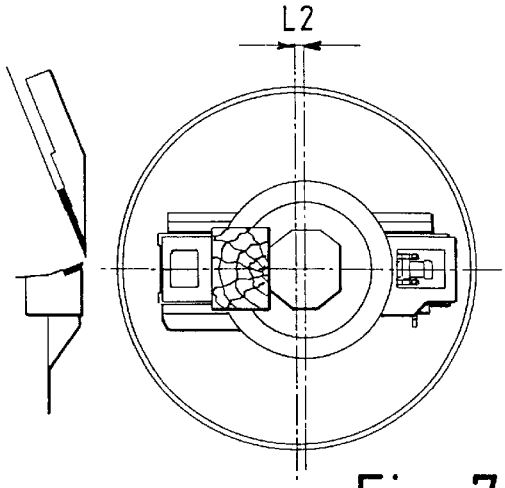

As shown diagrammatically in FIGS. 7*a*, 7*b*, the radial running along the guides 23, 24 allows increasing or decreasing the log rotation eccentricity. Advantageously, as shown in the FIGS., the radial running movement is included between a backed position and a forward position with respect to the chuck rotation axis and referred to the log. FIG. 6 shows the zero position.

The gripping means 21 comprise a stay log with a beam 26 with ends supported on the chucks through said guides 23. The beam supports laterally members with gripping teeth 27 which fit into purposeful cavities made in the log surface so as to constrain the log to the beam laterally as shown diagrammatically for example in FIGS. 6 and 8. This gripping system is readily imaginable to one skilled in the art and accordingly is be further shown nor described herein. Advantageously, between the guide means 23, 24 and the stay log head are placed rotation means for adjustment of the angular position of the gripping means around the rotation axis of the rotation means.

Again as seen in FIGS. 4 and 5 the rotation means comprise a circular guide 28 integral with the sliding blocks 24 and receiving rotatably a circular rim 29 fastened rigidly to the stay log head. For rotation movement the circular rim has a toothing 30 engaged by the pinion of a control motor 31.

Figure 7C:
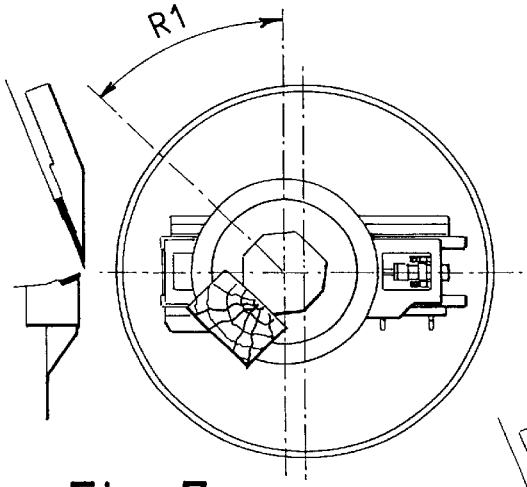
Figure 7D:
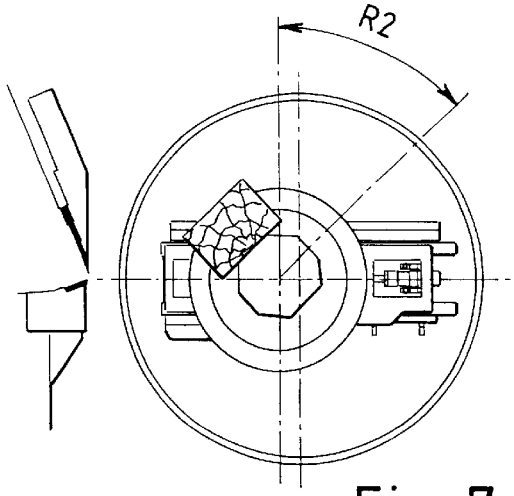

As may be seen in FIGS. 7*c* and 7*d* the angular change of the stay log can be between an advance value R1 and a lag value R2 with respect to the chuck rotation direction. Advantageous values are between 45° advance and 90° lag. The log thus has three possible movements, to wit, first a rotation movement because integral with the axis of the chucks, second, a relative radial translation movement L1 positive and L2 negative at the ends again with respect to the machine axis and, third, a relative angular rotation movement R1 in advance and R2 in lag with respect to the axis of the chucks.

Figure 8:
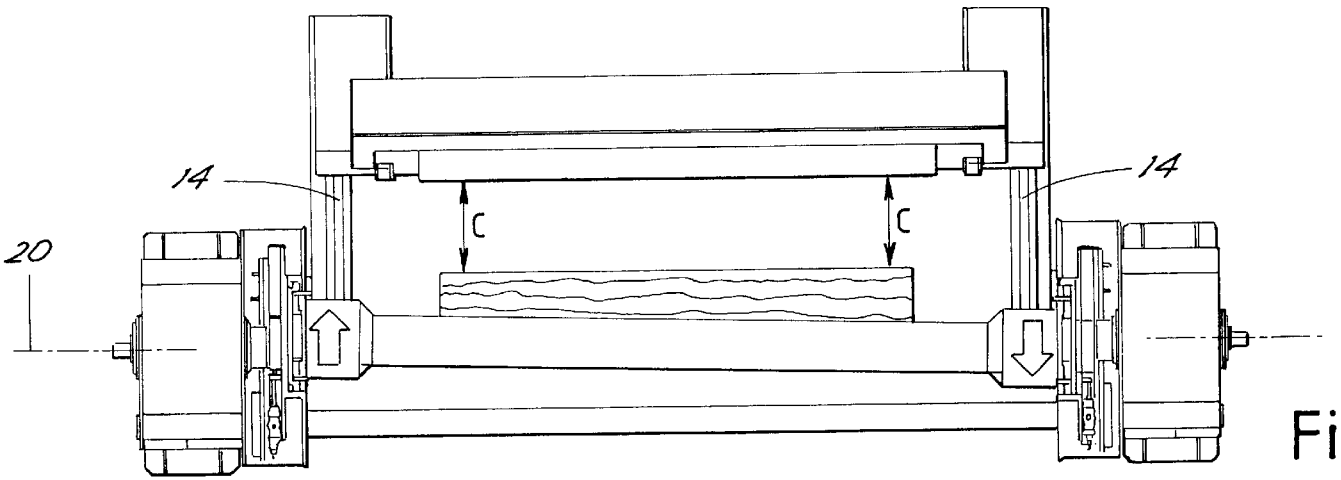
FIG. 8 shows another diagrammatic plan view of the station.

Being able to change the log inclination with respect to the blade makes it possible to present the outer surface of the plant parallel to the blade even with tapered shapes as seen in FIG. 8 where the log surface is at virtually constant distance C from the blade for the entire length of the log. In this manner it is possible to obtain sheets with greater dimensions by cutting the outer surface of the plant which is known to be the part with highest quality. Furthermore, it is possible to incline the log at varying angles to obtain different designs on the sheets due to the blade which cuts the wood fibers from appropriately selected surfaces.

The ability to move the control cylinders 25 synchronously or not makes it possible to move the log parallel to the blade. The capability of negative movement, i.e. withdrawing from the chuck rotation axis, makes it possible to further reduce the cutting trajectory radius to obtain larger sheets or sheets having more regular fiber designs. Naturally, the above description of an embodiment applying the innovative principles of the present invention is given by way of non-limiting example of said principles within the scope of the exclusive right claimed here.

What is claimed is:

1. A station for shearing wood sheets from a log comprising a shearing blade and a pair of chucks supporting log gripping means with the chucks being powered to rotate around an axis parallel to the blade characterized in that the gripping means are moveable to change the inclination of the gripped log with respect to said chuck rotation axis.

2. A station in accordance with claim 1 characterized in that the inclination of the log takes place in a plane passing through the rotation axis of the chucks.

3. A station in accordance with claim 1 characterized in that said log inclination change the gripping means are supported between the chucks with guide means associated with each chuck for effecting radial adjustment with respect to said rotation axis and with each chuck having an actuator for effecting controlled radial movement thereof independent of the associated gripping means and along the guide means associated with the respective chuck.

4. A station in accordance with claim 3 characterized in that the guide means can move to allow a movement of the gripping means such as to follow changes in the inclination of the log during said radial adjustment.

5. A station in accordance with claim 3 characterized in that the guide means have a locking system to prevent radial adjustment and said possibility of movement on command.

6. A station in accordance with claim 3 characterized in that the guide means comprise for each chuck two mutually parallel rectilinear guides arranged symmetrically with respect to the chuck rotation axis and integral with said chuck with sliding blocks integral with the gripping means running on two of said guidesl.

7. A station in accordance with claim 3 characterized in that the gripping means comprise a stay log having a beam with ends supported on the chucks with said guide means interposed therebetween and with the beam supporting laterally member with holding teeth with fit into purposeful cavities in the log surface to constrain the log to the beam.

8. A station in accordance with claim 3 characterized in that the radial adjustment movement is included between a retracted position and an advanced position of the constrained log with respect to the chuck rotation axis.

9. A station in accordance with claim 3 characterized in that the gripping means are supported on the guide means and rotation means interposed therebetween and allowing adjustment of the angular position of the gripping means around the rotation means rotation axis.

10. A station in accordance with claim 8 characterized in that the rotation means comprises a circular guide supported on said guide means and on which is received rotatably a rim integral with the gripping means and with a rotation control motor engaging with a toothing on the rim.

* * * * *